US006890227B1

(12) United States Patent
Alby et al.

(10) Patent No.: US 6,890,227 B1
(45) Date of Patent: May 10, 2005

(54) COMPACT JACK PLATE WITH IMPROVED ACCESS TO HYDRAULIC COMPONENTS

(75) Inventors: Jeremy L. Alby, Oshkosh, WI (US); Donald Anderson, Jr., Oshkosh, WI (US); Martin E. Olson Gunderson, Oshkosh, WI (US); Darin C. Uppgard, Neshkoro, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/774,808

(22) Filed: Feb. 9, 2004

(51) Int. Cl.[7] ..... B63H 5/125
(52) U.S. Cl. ..... 440/61 R; 248/640
(58) Field of Search ..... 440/56, 61 R; 248/640

(56) References Cited

U.S. PATENT DOCUMENTS

| | | | | |
|---|---|---|---|---|
| 4,482,330 | A * | 11/1984 | Cook | 440/2 |
| 4,575,342 | A * | 3/1986 | Nakahama et al. | 440/56 |
| 5,484,311 | A * | 1/1996 | Detwiler et al. | 440/61 R |
| D372,452 | S | 8/1996 | Icenogle | D12/317 |
| 5,782,662 | A | 7/1998 | Icenogle | 440/61 |
| 5,964,627 | A | 10/1999 | Detwiler | 440/58 |
| 6,132,271 | A | 10/2000 | Hebert | 440/59 |
| 6,146,220 | A | 11/2000 | Alby et al. | 440/53 |
| 6,183,321 | B1 | 2/2001 | Alby et al. | 440/61 |
| 6,227,920 | B1 | 5/2001 | Alby et al. | 440/53 |
| 6,305,996 | B1 | 10/2001 | Detwiler | 440/53 |

* cited by examiner

*Primary Examiner*—Stephen Avila
(74) *Attorney, Agent, or Firm*—William D. Lanyi

(57) ABSTRACT

A jack plate is configured to allow removal of hydraulic components from a fixed portion of the jack plate without having to remove an outboard motor from the jack plate. A mechanical stop device is provided which supports a movable member of the jack plate relative to a stationary member of the jack plate and, as a result, supports the outboard motor even as the hydraulic components are removed from the jack plate. This allows the hydraulic cylinder, hydraulic pump, and motor to be removed from the jack plate by loosening and then detaching a removable bracket member from the jack plate. As a result, the hydraulic system can be inspected, maintained, or replaced without having to remove the outboard motor from the jack plate.

27 Claims, 6 Drawing Sheets

COMPACT JACK PLATE WITH IMPROVED ACCESS TO HYDRAULIC COMPONENTS

BACKGROUND OF THE INVENTION

1. Field of the Invention

The present invention relates generally to a jack plate and, more specifically, to a jack plate that allows for partial disassembly of the jack plate structure without the requirement that the supported outboard motor be removed from the jack plate.

2. Description of the Prior Art

It is well known to those skilled in the art that a jack plate can be attached to a transom of a marine vessel for support of an outboard motor in such a way that the outboard motor can be raised or lowered relative to the position of the transom while the jack plate remains attached to the transom and the outboard motor remains attached to a movable portion of the jack plate. Some types of jack plates provide hydraulic devices to assist the operator of a marine vessel in raising and lowering the outboard motor by causing the movable portion of the jack plate to move relative to the stationary portion of the jack plate which is attached to the transom of the marine vessel.

U.S. Pat. No. 6,227,920, which issued to Alby et al. on May 8, 2001, discloses a fastener for attaching an outboard motor to a transom of a boat. The fastener for attaching a first component to a second component comprises an elongated opening formed in the first component with the elongated opening having a plurality of similarly shaped portions. An insert is disposable into each one of the plurality of similarly shaped portions and can be square in a preferred embodiment. Each of the plurality of the similarly shaped portions of the elongated opening is shaped to receive the insert therein. The insert is limited in movement by the elongated opening to a direction that is perpendicular to the plane of the elongated opening. A hole is formed in the second component and a cylindrical member is disposable through the insert, through the hole, and through the elongated opening. A capture mechanism prevents the insert from moving out of the elongated opening in a direction perpendicular to the plane of the elongated opening.

U.S. Pat. No. 6,183,321, which issued to Alby et al. on Feb. 6, 2001, discloses an outboard motor with a hydraulic pump and electric motor located within a steering mechanism. The outboard motor comprises a pedestal that is attached to a transom of a boat, a motor support platform that is attached to the outboard motor, and a steering mechanism that is attached to both the pedestal and the motor support platform. It comprises a hydraulic tilting mechanism that is attached to the motor support platform and to the outboard motor. The outboard motor is rotatable about a tilt axis relative to both the pedestal and the motor support platform. A hydraulic pump is connected in fluid communication with the hydraulic tilting mechanism to provide pressurized fluid to cause the outboard motor to rotate about its tilting axis. An electric motor is connected in torque transmitting relation with the hydraulic pump. Both the electric motor and the hydraulic pump are disposed within the steering mechanism.

U.S. Pat. No. 6,146,220, which issued to Alby, et al. on Nov. 14, 2000, discloses a pedestal mount for an outboard motor. An outboard motor is mounted to a transom of a boat with a pedestal that is attached either directly to the transom or to an intermediate plate that is, in turn, attached to the transom. A motor support platform is attached to the outboard motor, and a steering mechanism is attached to both pedestal and the motor support platform. The tilting mechanism is attached to the motor support platform and to the outboard motor. The outboard motor is rotatable about a tilting axis relative to both the pedestal and the motor support platform. The tilting mechanism is rotatable relative to the pedestal and about a steering axis. The steering axis is generally vertical and stationary relative to the pedestal and is unaffected by the tilting of the outboard motor. The tilting mechanism is rotatable relative to the pedestal and about the steering axis with the outboard motor.

U.S. Pat. No. 6,132,271, which issued to Hebert on Oct. 17, 2000, describes a jack plate for vertical and aft placement of an outboard motor. It is an apparatus for adjusting the position of a boat motor. The apparatus contains a first transom member extending perpendicular from the transom, with the first member having a first longitudinal slot therein; and a second transom member extending perpendicular from the transom, with the second member having a second longitudinal slot therein. The apparatus further includes an upper plate positioned between the first and second transom member, with the first plate being attached to the first transom member and the second transom member. Also included is a first motor bracket member slidably connected to the first transom bracket and a second motor bracket member slidably connected to the second transom bracket. The apparatus further includes a lower plate position between the first motor bracket member and the second motor bracket member, with the lower plate being attached to the first motor bracket member and the second motor bracket member. A central bolt having a threaded stem is disposed through a smooth bore in the upper plate and a threaded bore in the lower plate. A rotational force applied to the central bolt will move the lower plate. The movement of the lower plate will lower or raise the motor in relation to the boat's transom.

U.S. Pat. No. 5,782,662, which issued to Icenogle on Jul. 21, 1998, describes a hydraulic marine jack plate. The powered jack plate for use with a marine outboard motor in a marine environment is described. The inward side of the jack plate is attached to the transom of a boat. The outboard motor is attached to the outward side of the powered jack plate. Hydraulic power is the preferred power source. Hydraulic fluid is supplied by a separate hydraulic pump. The jack plate comprises a pair of opposing supports which are interconnected by support bars. The opposing supports incorporate linear bearings in which rides a slide which is capable of vertical movement. The linear bearings are provided with grease fittings for positive lubrication. The outward side of the opposing supports is higher than the inward side, thereby permitting maximum upward travel of the slide and the linear bearings are locked into the opposing supports via an undercut groove which is integral with these supports.

U.S. Pat. Des. 372,452, which issued to Icenogle on Aug. 6, 1996, describes a marine jack plate which is attachable to a transom of a marine vessel.

U.S. Pat. No. 6,305,996, which issued to Detwiler on Oct. 23, 2001, describes a variable height outboard motor mount. A manually adjustable outboard motor mount comprises two bracket assemblies, one being attachable to a boat transom and the other being attachable to support an outboard motor. The motor bracket assembly is constrained to movement in a straight, substantially vertical path relative to the transom bracket assembly by the cooperation of interengaging ribs and recesses on the brackets. The brackets, which have their ribs on their outer faces and their recesses on their inner faces, can be formed from a single extrusion. Cross braces fit into the recesses on the inner faces of the brackets.

U.S. Pat. No. 5,964,627, which issued to Detwiler on Oct. 12, 1999, describes a variable height outboard motor mount. A manually adjustable outboard motor mount comprises two brackets. One is attachable to a boat transom and one is attachable to an outboard motor. The motor bracket is constrained to movement in a straight, substantially vertical path relative to the transom bracket by the cooperation of rods on one bracket with spaced bearings in sleeves on the other bracket. The motor bracket is adjusted vertically by a shaft threaded into the transom bracket and rotatable in a combined thrust and journal bearing in the motor bracket. A nut on the threads of the shaft can be tightened against a plate of the transom bracket to lock the motor bracket against vertical movement. The nut has three radial arms disposed at 120 degree angles relative to one another to allow convenient manual tightening.

The patents described above are hereby expressly incorporated by reference in the description of the present invention.

Several problems are inherent in known types of jack plates. First, in order to remove the hydraulic components from a hydraulically powered jack plate, it is necessary to remove the outboard motor from the jack plate and disassemble the jack plate. In many cases, the removal of the outboard motor from the jack plate requires heavy lifting apparatus that is not available to many owners of marine vessels. In addition, known types of jack plates which incorporate hydraulic components can create undesirably high pressures within the hydraulic system when the jack plate reaches the end of its travel. In addition, known types of jack plates do not provide easily accessible means for the operator of a marine vessel to reduce the hydraulic pressure holding an outboard motor at a raised position. Furthermore, most known types of jack plates are sufficiently thick in a dimension extending rearwardly from the transom of a marine vessel that the outboard motor is supported at a location that is farther from the transom than is desirable in many applications.

It would therefore be significantly beneficial if a hydraulically powered jack plate could be provided that allows the operator of a marine vessel to disassemble the hydraulic components of the jack plate without having to remove the outboard motor from the jack plate. It would also be beneficial if a manually operable pressure relief valve could be located at an easily accessible location within the jack plate structure. In addition, it would be beneficial if an automatically operable pressure relief valve could be provided that prevents excessive pressure build up within the hydraulic lines when the jack plate reaches its maximum limit of travel.

SUMMARY OF THE INVENTION

A jack plate for a marine propulsion system made in accordance with a preferred embodiment of the present invention comprises a first member which is attachable to a marine vessel and a second member which is supported by the first member and is movable relative to the first member. It also comprises a hydraulic cylinder, having a piston rod disposed at least partially therein, which is attached between the first and second members. As a result, movement of the piston rod relative to the hydraulic cylinder causes the second member to move relative to the first member. The hydraulic cylinder is detachable from the first member while the second member remains supported by the first member.

In a particularly preferred embodiment of the present invention, it further comprises a mechanical stop device which is attached to the first member in order to prevent the second member from moving beyond a preselected location relative to the first member when the hydraulic cylinder is detached from the first member. The mechanical stop device can be disposed in threaded engagement within a hole formed in the first member.

The first member further comprises a removable bracket member with the hydraulic cylinder being attached to the bracket member.

The present invention can further comprise a hydraulic pump connected in fluid communication with the hydraulic cylinder and a motor connected in torque transmitting relation with the hydraulic pump. The hydraulic pump and the motor are attached for support to the first member. A manually activated pressure relief valve is attached to the hydraulic cylinder and easily accessible by the operator of a marine vessel when it is desirable to lower the outboard motor manually by releasing pressure within the hydraulic system. The manually activated pressure valve is accessible through an opening in the first member. An automatically activated pressure relief valve is connected in fluid communication with the hydraulic cylinder. The automatically activated pressure relief valve is configured to allow hydraulic fluid to return from the hydraulic cylinder to the hydraulic pump when the piston rod is extended from the hydraulic cylinder by a preselected amount.

BRIEF DESCRIPTION OF THE DRAWINGS

The present invention will be more fully and completely understood from a reading of the description of the preferred embodiment of the present invention in conjunction with the drawings, in which.

DESCRIPTION OF THE PREFERRED EMBODIMENT

Figure 1:
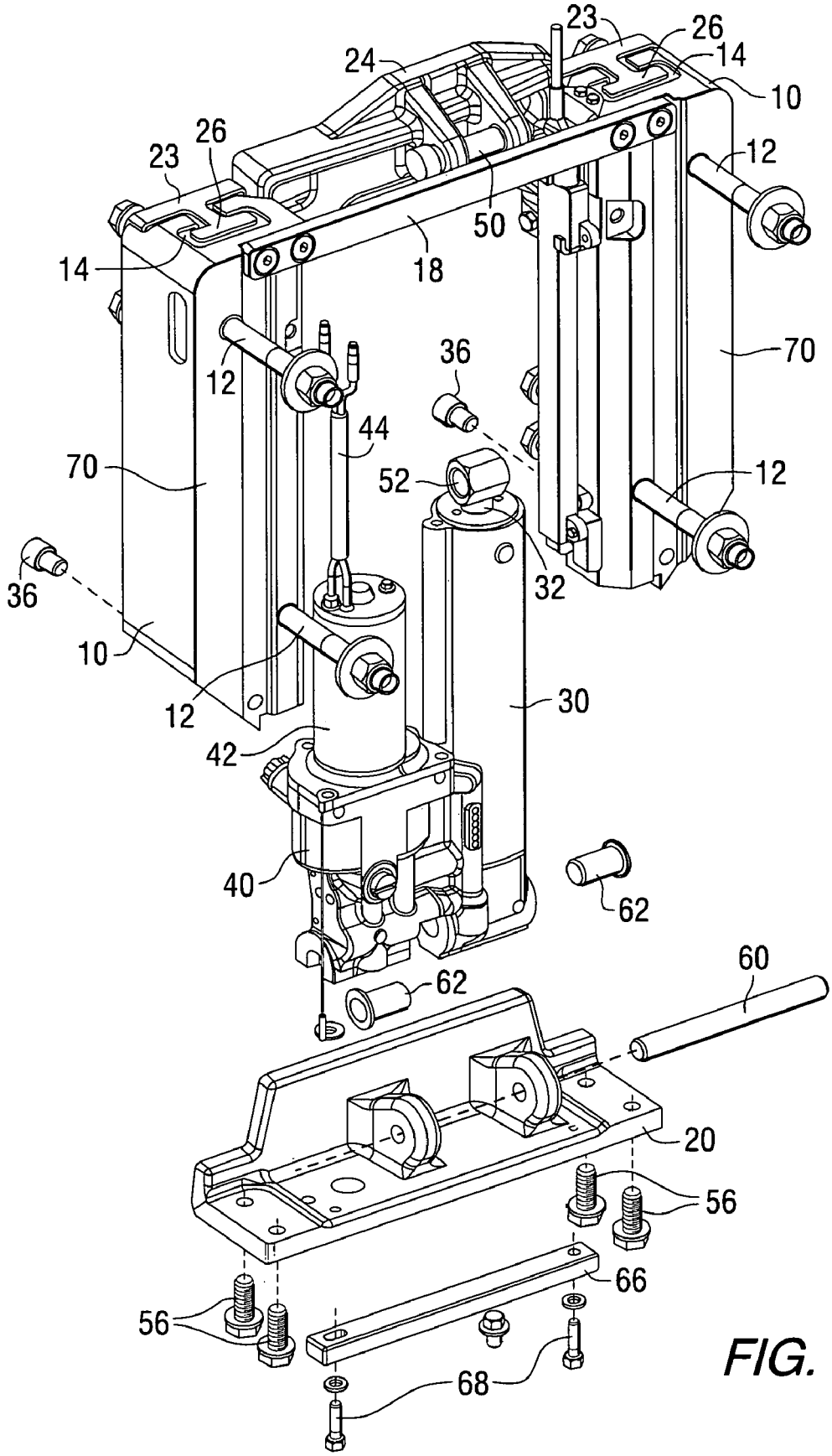
FIG. 1 is an exploded isometric view of the jack plate of the present invention.

Throughout the description of the preferred embodiment of the present invention, like components will be identified by like reference numerals.

FIG. 1 is an exploded isometric view of the present invention. The present invention comprises a first member which, in turn, comprises a first member 10 which includes two vertical columnar members that are attachable, by bolts 12, to a transom of a marine vessel. The first member 10 is shaped to provide a C-shaped track 14. The two portions of the first member 10 are connected together by a bar 18 and a removable bracket member 20.

A second member 24 is formed to provide an I-shaped member 26 that is slidably contained within the C-shaped track 14. This relationship allows the second member 24 to slide vertically relative to the first member 10 while being guided by the relationship between the I-shaped member 26 and the C-shaped member 14. A hydraulic cylinder 30, having a piston rod 32 disposed at least partially therein, is attached between the first and second members, 10 and 24. As a result of this relationship, movement of the piston rod 32 relative to the hydraulic cylinder 30 causes the second member 24 to move relative to the first member 10. The hydraulic cylinder 30 is detachable from the first member 10 while the second member 24 remains supported by the first member 10. As will be described in greater detail below, a mechanical stop device is provided to support the second member 24 even when the hydraulic cylinder 30 and its related components are removed from contact with the first member 10. The mechanical stop device can comprise a pair of threaded bolts 36 that are supported in threaded engagement within associated holes formed in the first member 10. As will be described below, the heads of the threaded bolts 36 prevent the second member 24 from sliding downward relative to the first member 10 beyond a preselected location which is defined by the position of the heads of the threaded bolts 36. The first member 10 comprises the removable bracket member 20 and the hydraulic cylinder 30 is attached to the removable bracket member 20. Also attached to the removable bracket member 20 is a hydraulic pump 40 and a motor 42. The motor is provided with electrical power, through conductor 44, and drives the hydraulic pump 40 which pressurizes hydraulic fluid for use in the hydraulic cylinder 30. As a result, the piston rod 32 can be forced upward and extended away from the cylinder 30. A pin 50 can be extended through holes in the second member 24, as illustrated in FIG. 1, and also through a hole 52 provided at the end of the piston rod 32. When connected in this way, extension of the piston rod 32 from the hydraulic cylinder 30 causes the second member 24 to move upward and away from the removable bracket member 20 which, during operation, is rigidly attached by bolts 56 to the bottom ends of the two components that provide the first rail device.

Also shown in FIG. 1 is a rod 60 that provides a connection between the hydraulic assembly and the removable bracket member 20. The hydraulic assembly comprises the hydraulic cylinder 30, the hydraulic pump 40, and the motor 42. Bushings 62 are located over the rod 60 when it is inserted through a cylindrical opening extending through the hydraulic assembly. Also shown in FIG. 1 is a sacrificial anode 66 and two bolts 68 which are used to attach the sacrificial anode to the removable bracket member 20.

With continued reference to FIG. 1, it should be understood that the first member 10 is attachable to a transom of a marine vessel with the surfaces placed in contact with a surface of the transom. An outboard motor is attachable to the second member 24. Actuation of the hydraulic cylinder 30 therefore can raise the outboard motor by raising the second member 24 relative to the first member 10 which is attached to the marine vessel.

Figure 2:
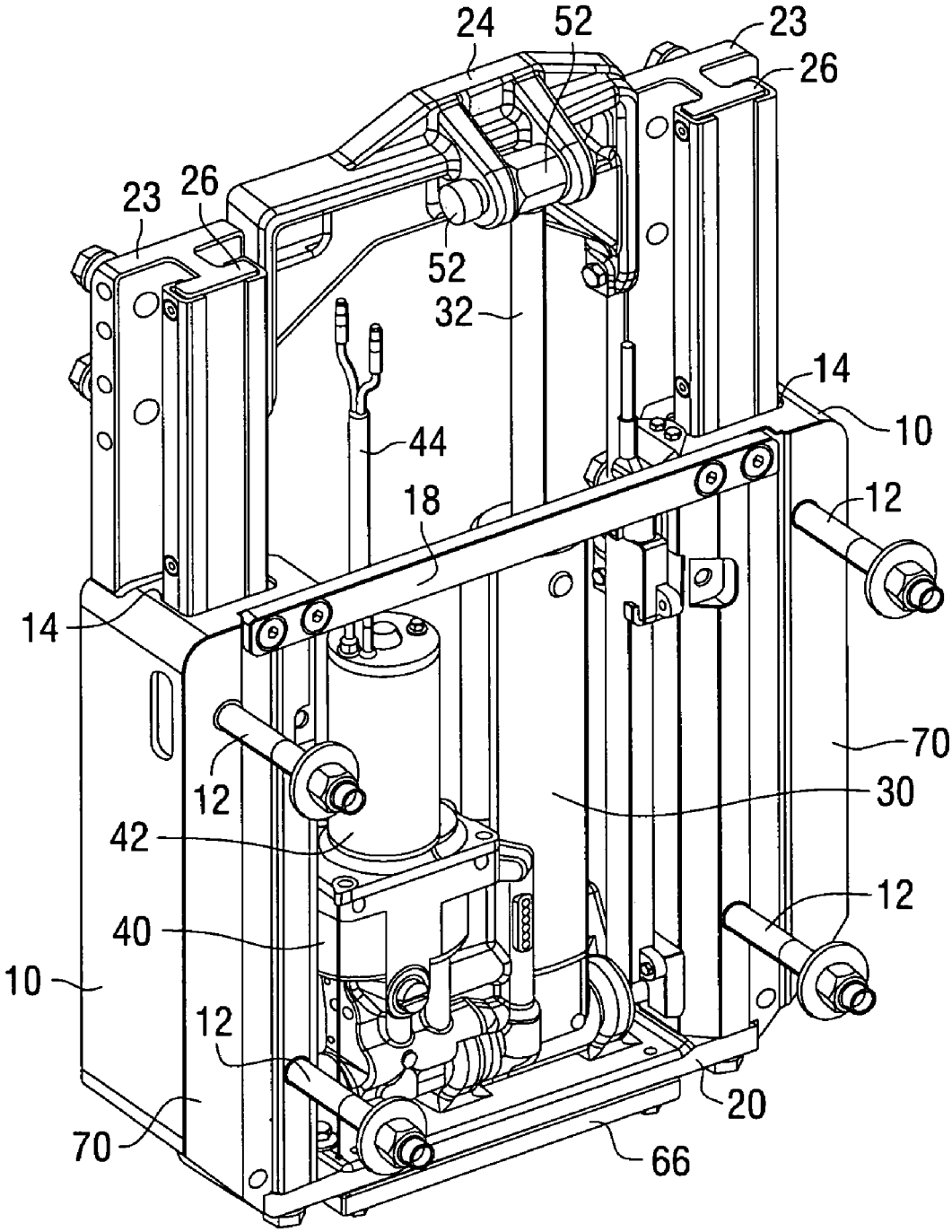
FIG. 2 is an assembled view of the jack plate in an extended configuration.

FIG. 2 is similar to FIG. 1, but with all of the components assembled together. In FIG. 2, the second member 24 is shown partially raised in an upward direction away from the first member 10 as a result of the piston rod being extended from the hydraulic cylinder 30. It can be seen that the hydraulic cylinder 30 and piston rod 32 are connected between the first member 10 and the second member 24. This allows extension of the piston rod 32 from the hydraulic cylinder 30 to exert a separating force between the first and second members, 10 and 24, which pushes the second member 24 upward as shown.

Figure 3:
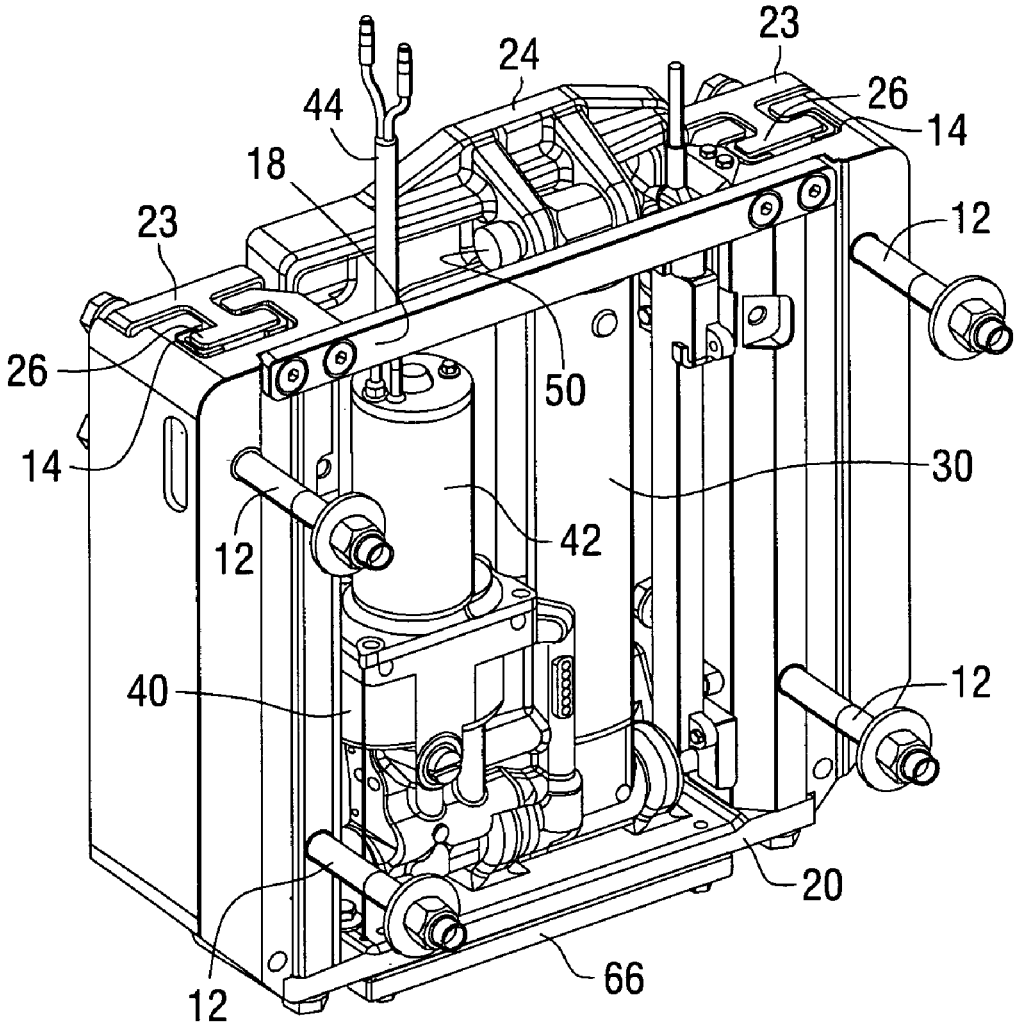
FIG. 3 is an isometric view of the jack plate in a retracted position.

FIG. 3 is similar to FIG. 2, but with the second member 24 retracted downwardly into the space defined by the first member 10. This is accomplished by retracting the piston rod 32 into the hydraulic cylinder 30. The bolts 12, as described above, are used to attach the jack plate assembly to the transom of a marine vessel. This attachment retains the first member 10 at a specific location relative to the transom of the marine vessel while allowing the second member 24 to move upwardly or downwardly, as constrained by the relationship between the I-shaped portion 26 of the second rail device and the C-shaped portion 14 of the first rail device.

Figure 4:
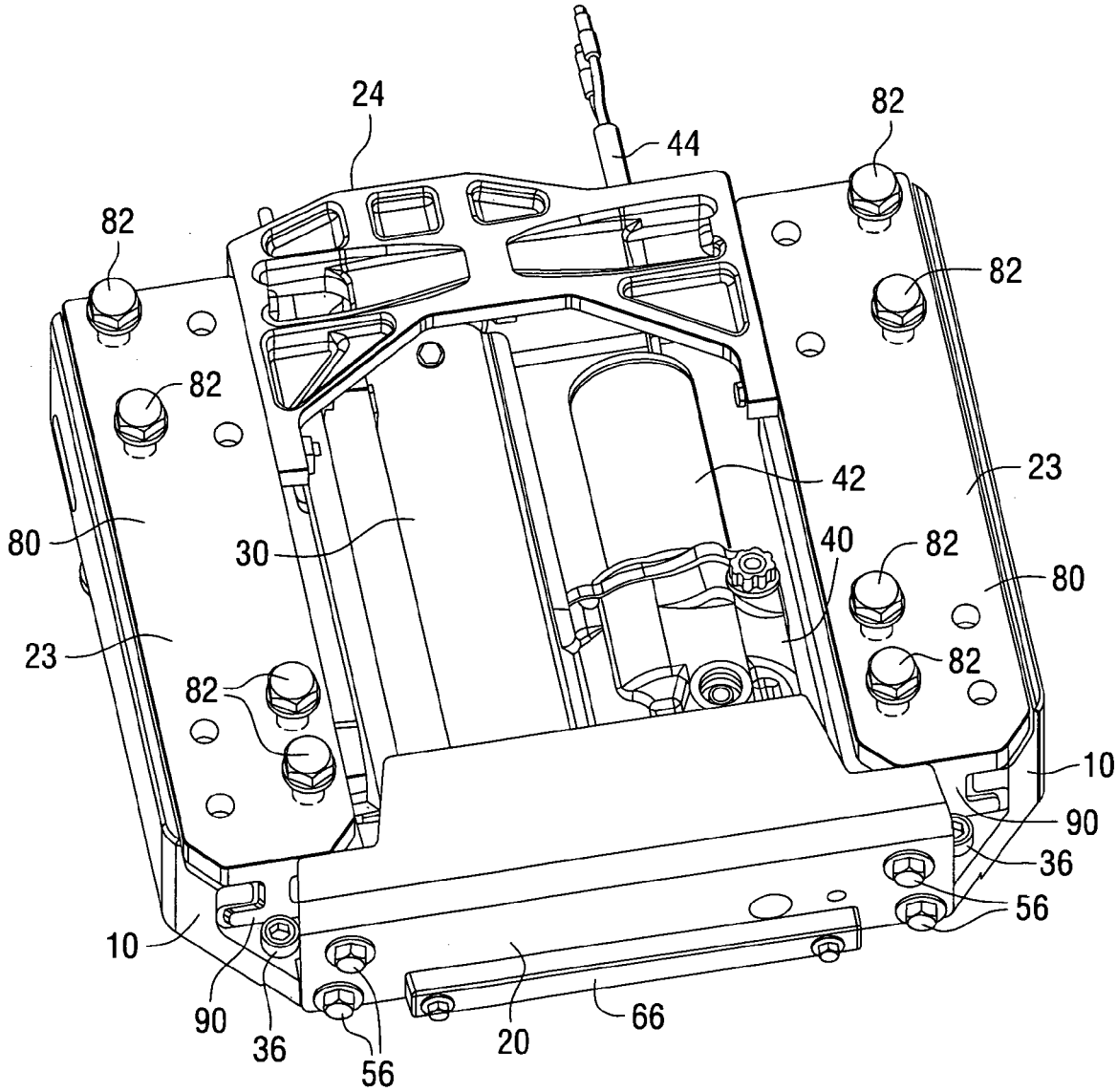
FIG. 4 is an isometric view of the retracted jack plate from a direction which is opposite to that of FIG. 3.

FIG. 4 is generally similar to FIG. 3, but represents an isometric view of the jack plate that is viewed from an opposite side than FIG. 3. The surfaces 80 of the second member 24 are placed in contact with an outboard motor that is attached to the second member 24 by the plurality of bolts 82. This provides a rigid attachment between an outboard motor and the second member 24. The threaded bolts 36 are threaded into holes in the first member 10 so that the heads of the threaded bolts 36 prevent surface 90 of the second rail device 23 from moving downwardly past the location defined by the heads of the threaded bolts 36. Therefore, if the bolts 56 are loosened to allow the removable bracket member 20 to move away from the remaining portions of the first member 10, the second member 24 will be prevented from continuing downwardly past the location defined by the heads of the threaded bolts 36. This allows the removable bracket member 20 and the hydraulic components, 30, 40, and 42, to be removed from the jack plate without requiring that the outboard motor be removed from the jack plate. The heads of the threaded bolts 36 provide a mechanical stop device that allows the outboard motor to be supported by those heads even as the removable bracket member 20 and the hydraulic components are loosened and removed from the assembly.

With reference to FIGS. 1–4, an operator of a marine vessel can loosen bolts 56 to allow the hydraulic components, 30, 40, and 42, to drop away from the first member 10 of the jack plate. As the bolts 56 are loosened, the second member 24 will begin to lower relative to the first member 10 until the bottom surfaces 90 of the second member 24 move into contact with the heads of the threaded bolts 36. It will stop at that location and allow the removable bracket 20 to be further loosened and removed from the jack plate assembly. The rod 50 can then be removed from its associated holes in the second member 24 and from the hole 52 formed in the end of the piston rod 32. This allows the hydraulic assembly to be removed while the outboard motor remains in contact with the second member 24.

Figure 5:
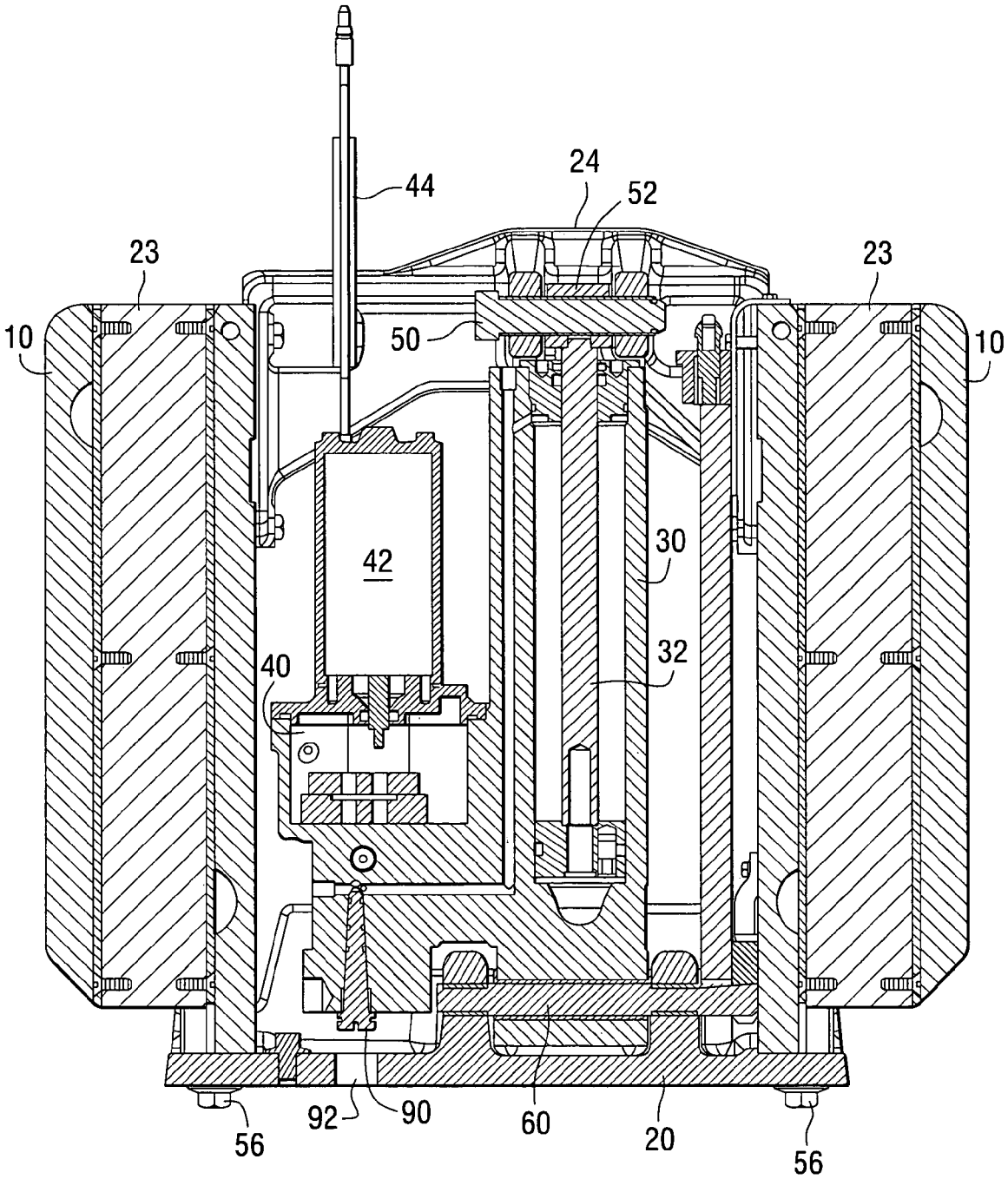
FIG. 5 is a section view taken through the jack plate of the present invention.

FIG. 5 is a section view taken through the jack plate described above along a plane that is generally parallel to surfaces 70 and 80. The first member 10 and second member 24 can be seen, along with the second rail device 23 which is disposed within the C-shaped first rail device of the first member 10. The hydraulic cylinder 30, the piston rod 32, the motor 42, and the hydraulic pump 40 can also be seen in their position which is defined by their attachment to the removable bracket member 20 by rod 60. The upper end of the piston rod 32, which is identified by reference numeral 52, is attached to the second member 24 by pin 50.

With continued reference to FIG. 5, a manually activated pressure relief valve 90 is accessible through an opening 92 in the first member 10. More specifically, the opening 92 is formed through the removable bracket member 20 which is a part of the first member 10 and rigidly attached to the first member 10 during normal operation of the jack plate. By loosening the manually activated pressure relief valve 90, the operator can cause the hydraulic cylinder 30 to permit the piston rod 32 to retract into the cylinder. This, in turn, allows the second member 24 to move downwardly as the piston rod 32 retracts. Then, bolts 56 can be loosened to allow the removable bracket member 20 to be gradually released from its rigid attachment to the bottom portions of the first rail device. As the bolts 56 are loosened, the weight of the outboard motor and second member 24 will cause the second member 24 to move downward with the loosened removable bracket member 20. After a slight movement downward, the bottom surfaces 90 of the second rail device 23 will eventually move into contact with the heads of the threaded bolts 36 which were described above in conjunction with FIG. 1. From that point onward, the second member 24 will be supported by the heads of the threaded bolts 36 and the removable bracket member 20 can be loosened and eventually disconnected from the first member 10. The pin 50 can then be removed to disengage the piston rod 32 from the second member 24. When this is accomplished, the removable bracket member 20 and the hydraulic components can be lowered and removed from the jack plate. The hydraulic components, which include the hydraulic cylinder 30, the motor 42, and the hydraulic pump 40, can be repaired or replaced without having to remove the outboard motor from the jack plate. Alternatively, routine maintenance can also be performed on the hydraulic components.

Figure 6:
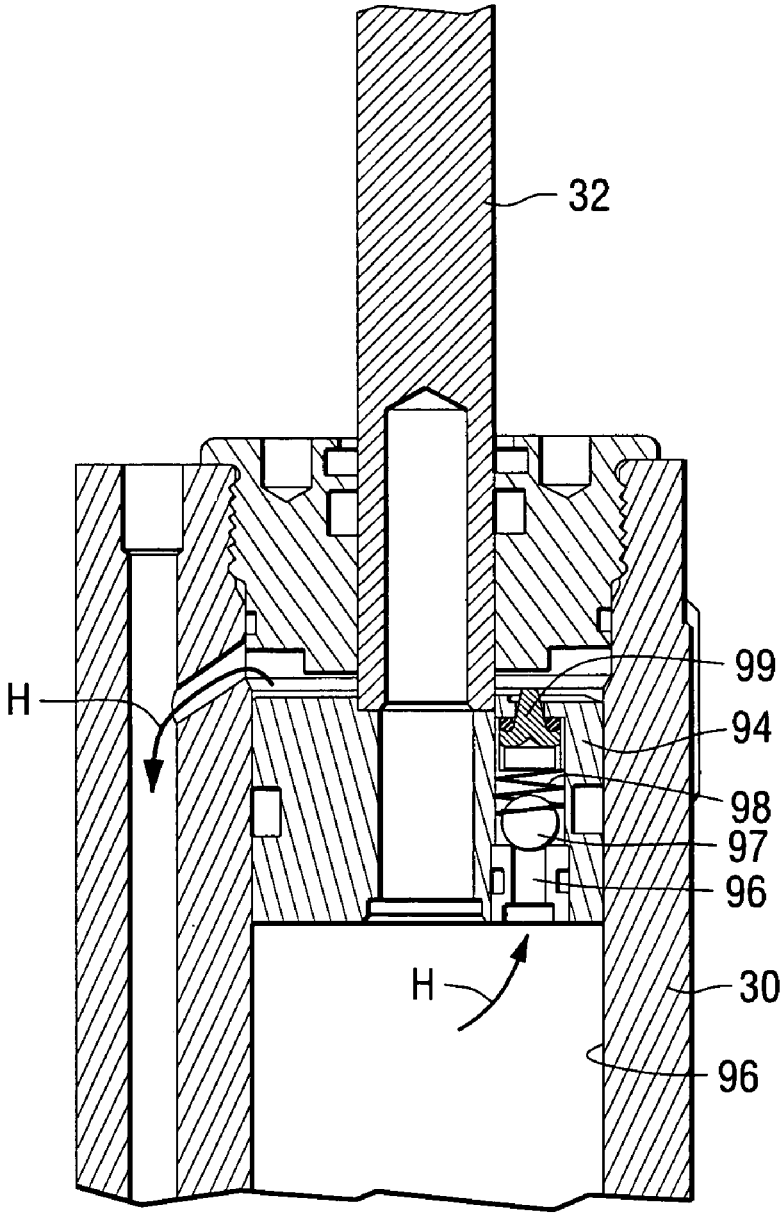
FIG. 6 is a partial section view of an upper portion of a hydraulic cylinder of the jack plate of the present invention.

FIG. 6 is a partial section view of the upper end of the hydraulic cylinder 30. The lower end of the piston rod 32 is shown attached to a piston 94 that moves up and down within the cylindrical opening 96 of the hydraulic cylinder 30. The piston 94 is provided with a ball check valve that comprises a fluid conduit 96 when the piston 94 is at a position other than the upward maximum point of travel which is shown in FIG. 6, the fluid passing through conduit 96 is not provided with a passage past the ball 97 because of the movable plug 99. However, when the piston 94 reaches the upward maximum point of travel, the plug 99 is pushed downwardly to open a passage through which hydraulic fluid can flow upwardly through conduit 96, past ball 97, and around the plug 99 to return to the hydraulic pump 40 which is illustrated in section view in FIG. 5. This relieves the pressure within the cylinder 30 below the piston 94. The mechanism shown in FIG. 6 provides an automatically activated pressure relief valve which is connected in fluid communication with the hydraulic cylinder 30. The automatically activated pressure relief valve is configured to allow hydraulic fluid to return from the hydraulic cylinder 30 to the hydraulic pump 40 when the piston rod 32 is extended from hydraulic cylinder 30 by a preselected amount. That preselected amount, in a preferred embodiment of the present invention, occurs when the piston 94 reaches the upward limit of its travel as illustrated in FIG. 6. This moves the plug 99 downward to open the passage through which hydraulic fluid can flow upwardly through conduit 96 and past ball 97. Arrows H in FIG. 6 illustrate this path along which the hydraulic fluid is allowed to escape from the cylindrical cavity 96 of the hydraulic cylinder 30 back to the hydraulic pump 40.

With references to FIGS. 1–6, it can be seen that a jack plate for a marine propulsion system, made in accordance with a preferred embodiment of the present invention, comprises a first member 10 which is attachable to a marine vessel by bolts 12. It also comprises a second member 24 which is supported by the first member 10 and is movable relative to the first member 10. A hydraulic cylinder 30 has a piston rod 32 disposed at least partially therein. The hydraulic cylinder 30 is attached between the first and second members, 10 and 24, whereby movement of the piston rod 32 relative to the hydraulic cylinder 30 causes the second member 24 to move relative to the first member 10. The hydraulic cylinder 30 is detachable from the first member 10 while the second member 24 remains supported by the first member 10. A mechanical stop device 36 is attached to the first member 10 to prevent the second member 24 from moving beyond a preselected location relative to the first member 10 when the hydraulic cylinder 30 is detached from the first member 10. The mechanical stop device 36 is disposed in threaded engagement within a hole formed in the first member 10.

The first member 10 comprises a removable bracket member 20. The hydraulic cylinder 30 is attached to the removable bracket member 20. A hydraulic pump 40 is connected in fluid communication with the hydraulic cylinder 30. A motor 42 is connected in torque transmitting relation with the hydraulic pump 40. The hydraulic pump 40 and the motor 42 are attached for support to the first member 10 and, more particularly, to the removable bracket member 20 which is a portion of the first member 10. A manually activated pressure relief valve 90 is connected in fluid communication with the hydraulic cylinder 30. The manually activated pressure relief valve 90 is accessible, through opening 92, in the first member 10 and, more particularly, the opening 92 is formed through the removable bracket member 20. An automatically activated pressure relief valve 99 is connected in fluid communication with the hydraulic cylinder 30. The automatically activated pressure relief valve 99 is configured to allow hydraulic fluid to return from the hydraulic cylinder 30 to the hydraulic pump 40 when the piston rod 32 is extended from the hydraulic cylinder 30 by a preselected amount.

The first member 10 comprises a first rail device 14 and a second member 24 comprises a second rail device 23. The first and second rail devices are associated together to allow the second member 24 to slide relative to the first member 10. The hydraulic cylinder 30 is detachable from the first member 10 by detaching the removable bracket member 20 from the first member 10.

Although the present invention has been described and illustrated in relation to a particularly preferred embodiment, it should be understood that alternative embodiments are also within its scope.

What is claimed is:

1. A jack plate for a marine propulsion system, comprising:

a first member which is attachable to a marine vessel;

a second member which is supported by said first member and movable relative to said first member; and a hydraulic cylinder, having a piston rod disposed at least partially therein, attached between said first and second members, whereby movement of said piston rod relative to said hydraulic cylinder causes said second member to move relative to said first member, said hydraulic cylinder being detachable from said first member while said second member remains supported by said first member.

2. The jack plate of claim 1, further comprising:

a mechanical stop device attached to said first member to prevent said second member from moving beyond a preselected location relative to said first member when said hydraulic cylinder is detached from said first member.

3. The jack plate of claim 2, wherein:

said mechanical stop device is disposed in threaded engagement within a hole formed in said first member.

4. The jack plate of claim 1, wherein:

said first member comprises a removable bracket member, said hydraulic cylinder being attached to said removable bracket member.

5. The jack plate of claim 1, further comprising:

a hydraulic pump connected in fluid communication with said hydraulic cylinder.

6. The jack plate of claim 5, further comprising:

a motor connected in torque transmitting relation with said hydraulic pump.

7. The jack plate of claim 6, wherein:

said hydraulic pump and said motor are attached for support to said first member.

8. The jack plate of claim 1, further comprising:

a manually activated pressure relief valve connected in fluid communication with said hydraulic cylinder.

9. The jack plate of claim 8, wherein:

said manually activated pressure relief valve is accessible through an opening in said first member.

10. The jack plate of claim 1, further comprising:

an automatically activated pressure relief valve which is connected in fluid communication with said hydraulic cylinder, said automatically activated pressure relief valve being configured to allow hydraulic fluid to return from said hydraulic cylinder to said hydraulic pump when said piston rod is extended from said hydraulic cylinder by a preselected amount.

11. The jack plate of claim 1, wherein:

said first member comprises a first rail device; and said second member comprises a second rail device, said first and second rail devices being associated together to allow said second member to slide relative to said first member.

12. The jack plate of claim 1, wherein:

said hydraulic cylinder is detachable from said first member by detaching said removable bracket member from said first member.

13. A jack plate for a marine propulsion system, comprising:

a first member which is attachable to a marine vessel, said first member comprising a removable bracket member;

a second member which is supported by said first member and movable relative to said first member; and a hydraulic cylinder, having a piston rod disposed at least partially therein, attached between said first and second members, whereby movement of said piston rod relative to said hydraulic cylinder causes said second member to move relative to said first member, said hydraulic cylinder being detachable from said first member while said second member remains supported by said first member, said hydraulic cylinder being attached to said removable bracket member.

14. The jack plate of claim 13, further comprising:

a mechanical stop device attached to said first member to prevent said second member from moving beyond a preselected location relative to said first member when said hydraulic cylinder is detached from said first member.

15. The jack plate of claim 14, wherein:

said mechanical stop device is disposed in threaded engagement within a hole formed in said first member.

16. The jack plate of claim 13, further comprising:

a hydraulic pump connected in fluid communication with said hydraulic cylinder; and a motor connected in torque transmitting relation with said hydraulic pump.

17. The jack plate of claim 16, wherein:

said hydraulic pump and said motor are attached for support to said first member.

18. The jack plate of claim 17, further comprising:

a manually activated pressure relief valve connected in fluid communication with said hydraulic cylinder, said manually activated pressure relief valve being accessible through an opening in said first member.

19. The jack plate of claim 18, further comprising:

an automatically activated pressure relief valve which is connected in fluid communication with said hydraulic cylinder, said automatically activated pressure relief valve being configured to allow hydraulic fluid to return from said hydraulic cylinder to said hydraulic pump when said piston rod is extended from said hydraulic cylinder by a preselected amount.

20. The jack plate of claim 13, wherein:

said first member comprises a first rail device; and said second member comprises a second rail device, said first and second rail devices being associated together to allow said second member to slide relative to said first member.

21. The jack plate of claim 13, wherein:

said hydraulic cylinder is detachable from said first member by detaching said removable bracket member from said first member.

22. A jack plate for a marine propulsion system, comprising:

a first member which is attachable to a marine vessel, said first member comprising a removable bracket member;

a second member which is supported by said first member and movable relative to said first member; and a hydraulic cylinder, having a piston rod disposed at least partially therein, attached between said first and second members, whereby movement of said piston rod relative to said hydraulic cylinder causes said second member to move relative to said first member, said hydraulic cylinder being detachable from said first member while said second member remains supported by said first member, said hydraulic cylinder being attached to said removable bracket member;

a mechanical stop device attached to said first member to prevent said second member from moving beyond a preselected location relative to said first member when said hydraulic cylinder is detached from said first member;

a hydraulic pump connected in fluid communication with said hydraulic cylinder, said hydraulic pump and said motor being attached for support to said first member; and a motor connected in torque transmitting relation with said hydraulic pump.

23. The jack plate of claim 22, wherein:

said mechanical stop device is disposed in threaded engagement within a hole formed in said first member.

24. The jack plate of claim 22, further comprising:

a manually activated pressure relief valve connected in fluid communication with said hydraulic cylinder, said manually activated pressure relief valve being accessible through an opening in said first member.

25. The jack plate of claim 22, further comprising:

an automatically activated pressure relief valve which is connected in fluid communication with said hydraulic cylinder, said automatically activated pressure relief valve being configured to allow hydraulic fluid to return from said hydraulic cylinder to said hydraulic pump when said piston rod is extended from said hydraulic cylinder by a preselected amount.

26. The jack plate of claim 22, wherein:

said first member comprises a first rail device; and said second member comprises a second rail device, said first and second rail devices being associated together to allow said second member to slide relative to said first member.

27. The jack plate of claim 22, wherein:

said hydraulic cylinder is detachable from said first member by detaching said removable bracket member from said first member.

* * * * *